United States Patent [19]

White

[11] Patent Number: 4,843,645

[45] Date of Patent: Jul. 4, 1989

[54] SLEEVE PROTECTOR

[76] Inventor: Lisa G. White, 122 Saralyn Dr., Blackwell, Okla. 74631

[21] Appl. No.: 185,991

[22] Filed: Apr. 25, 1988

[51] Int. Cl.[4] ..... A41D 13/08

[52] U.S. Cl. ..... 2/59

[58] Field of Search ..... 2/59

[56] References Cited

U.S. PATENT DOCUMENTS

| | | | |
|---|---|---|---|
| 946,541 | 1/1910 | Fletcher | 2/59 |
| 1,284,536 | 11/1918 | Yaeger | 2/59 |
| 1,949,773 | 3/1934 | Amend et al. | 2/59 |
| 2,058,040 | 10/1936 | Severn | 2/59 X |
| 2,059,136 | 10/1936 | Moller | 2/59 X |
| 2,234,582 | 3/1941 | Schneider | 2/59 X |
| 2,459,992 | 1/1949 | Cimino | 2/59 X |
| 2,534,313 | 12/1950 | Starkey | 2/59 X |
| 3,837,007 | 9/1974 | Girest | 2/59 X |
| 4,036,220 | 7/1977 | Bellasalma | 2/59 X |

OTHER PUBLICATIONS

Maurice Gershman, "Self Adhering Nylon Tapes", the *Journal of the AMA,* vol. 168, No. 7, Oct. 19, 1958, p. 930.

*Primary Examiner*—Werner H. Schroeder
*Assistant Examiner*—Jeanette E. Chapman
*Attorney, Agent, or Firm*—James Creighton Wray

[57] ABSTRACT

A sleeve protector is formed of a tube of polymeric material with an elastic insert at the wrist end for tightly surrounding the wrist. The tube is slit more than halfway axially, and a flap of material is extended over the slit so that it overlies material at the opposite side of the slit. Two pairs of complementary Velcro fasteners attach the overlapping flap to the material adjacent the slit. One fastener at the elbow end is elongated to allow circumferential size adjustment. The slit and flap extend more than halfway along the tube and preferably about 3/5 of the way along the tube, to provide easy insertion of a hand and sleeve within the tube and to ensure that a sleeve does not bunch up as the arm is being pushed into the tube and to ensure that the sleeve is covered by the tubular protector.

10 Claims, 1 Drawing Sheet

SLEEVE PROTECTOR

BACKGROUND OF THE INVENTION

Children often soil and stain the sleeves of school clothes, especially during art classes.

While many sleeve protectors have been made, none has addressed the simplicity and ease of use required for use by children.

None has addressed the problems of ease of use and ease of insertion of hands, wrists, forearms and sleeves without bunching of sleeves with quick and easy insertion.

Slitlike openings at wrist ends make it difficult to prevent ingress of soiling materials. Elastic at both ends makes it difficult to fully insert a sleeve without bunching. Zippered, full-length closures promote jamming or catching or tearing of sleeves. Snap closures are difficult to operate. Wraparound sheets are difficult to use.

A need exists for a sleeve protector which is easily put on and easily removed and which fully protects sleeves from soils and stains associated with school projects, particularly art.

SUMMARY OF THE INVENTION

The present invention provides a sleeve protector which is easily put on and which provides easy insertion of a hand, wrist and forearm and sleeve without bunching the material of the sleeve or uncomfortably pushing the sleeve along a forearm. The sleeve protector of the present invention provides ease of one-handed closure and ease of one-handed opening for removal of the protector after a task is complete.

A preferred children's sleeve protector has a tube made of a flexible fabric material with a distal wrist end and a proximal elbow end. First means at the wrist end radially inwardly urges the wrist end against the wrist of a user. A seam means extends axially along a tube from the distal end. An axial opening extends axially along the tube from the proximal end to the seam. A closure extends axially along the tube commensurate with the opening for closing the opening. Complementary fasteners connected to the closure and to the tube adjacent the opening hold the closure closed for closing the opening.

In the preferred sleeve protector, the seam extends less than halfway axially along the tube, and the opening and closure extend more than halfway axially along the tube.

Preferably, the seam extends about 40% of the axial length, and the opening and closure extend about 60% of the axial length for providing ease of access and introduction of a sleeve to be protected within the opening and within the sleeve protector.

In the preferred sleeve protector the opening comprises an axial extension of one side of the seam, and the closure means comprises a flap attached to the material and extending circumferentially in a direction beyond an extension of the other side of the seam.

Preferably, first complementary pile and hook type fastener patches are fixed respectively on an inside corner of a portion of the flap which is closest the seam and on the material at a position spaced slightly from an intersection of the opening and the seam. Second complementary fasteners are attached to an inside of the flap near the proximal end and to the material near a proximal end of the opening.

In the preferred sleeve protector the second complementary fasteners comprise a felt patch attached to an outside surface of the tube adjacent the proximal end and a complementary elongated hook-type fastener strip, elongated along a proximal edge of an inner surface of the flap for engaging the pile fastener patch of the second fastener means in one of variable positions to control circumferential dimension of the proximal end of the sleeve protector tube.

Preferably, the sleeve protector wrist tightening means comprises an elastic insert in the sleeve protector within the distal end.

A preferred closure is a flap formed of the material of the tube and extending over an axial portion of the material adjacent the opening and fastened thereto by the fasteners means for providing ease of access of a hand, wrist and forearm and a clothing sleeve into the sleeve protector before the flap is closed over the opening means.

A preferred children's sleeve protector has an elongated tube formed of flexible, moistureproof fabric material having a wrist end and an elbow end. Elastic means at the wrist end closely surrounds a child's wrist. An axial opening extends more than halfway along the tube from the elbow end for allowing ease of passage through the tube of a child's hand and wrist and for allowing ease of entry into the tube the sleeve of a child's garment without bunching. A flap made of an extended portion of the fabric material extends over the opening to close the opening after a hand, wrist, arm and sleeve have been inserted. First complementary hook and pile type fastener patches respectively are connected to an inner corner of the flap near an end of the opening remote from the elbow end and on an outer surface of the tube near the opening remote from the elbow end. Second hook and pile type fastener patches are mounted on an inside of the flap near the elbow end and on an outside of the tube near an inner section of the elbow end and opening.

Preferably, the second fastener patches comprise a square pile type fastener patch connected to an outside of the tube near an intersection of the opening and elbow end and an elongated, rectangular, complementary fastener patch mounted on an inside of the flap and extending along an elbow edge of the flap.

This invention provides a sleeve protector formed of a tube of polymeric material with an elastic insert at the wrist end for tightly surrounding the wrist. The tube is slit more than halfway axially, and a flap of material is extended over the slit so that it overlies material at the opposite side of the slit. Two pairs of complementary Velcro fasteners attach the overlapping flap to the material adjacent the slit. One fastener at the elbow end is elongated to allow circumferential size adjustment.

The slit and flap extend more than halfway along the tube and preferably about 3/5 of the way along the tube, to provide easy insertion of a hand and sleeve within the tube and to ensure that a sleeve does not bunch up as the arm is being pushed into the tube and to ensure that the sleeve is covered by the tubular protector.

The above and further and other objects and features of the invention are apparent in the disclosure which includes the specification with the above and ongoing description and the claims and which includes the drawings.

DETAILED DESCRIPTION OF THE DRAWINGS

Figure 2:
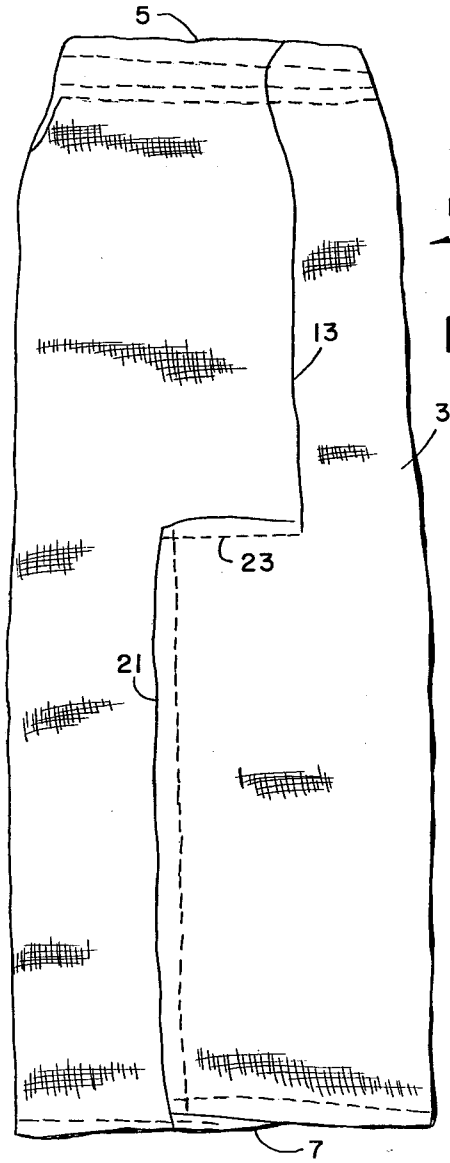
FIG. 2 is a view of the sleeve protector of FIG. 1 with the flap closed.
Figure 1:
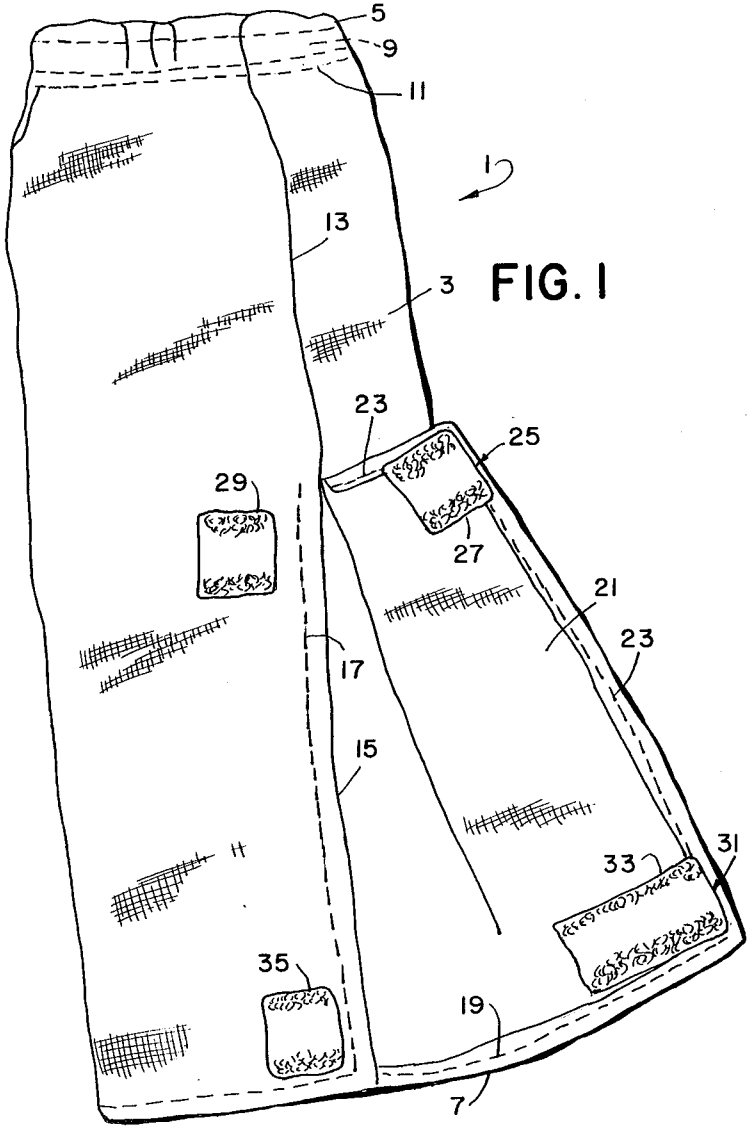
FIG. 1 is a view of the tubular sleeve protector with the flap opened.

Referring to FIGS. 1 and 2, a sleeve protector of the invention is generally indicated by the numeral 1. The sleeve protector is constructed of any lightweight, flexible, moistureproof fabric material, in this case ripstop nylon, or Goretex. The sleeve protector I may be made of any lightweight material which is resistant to flowing through of stains or soil. The material may be treated with a water-protective coating, such as, for example, Scotchguard. The sleeve protector is formed as a tube 3, having a distal wrist surrounding end 5 and a proximal elbow end 7 which surrounds a sleeve around an upper forearm area of a wearer. In a preferred embodiment, the sleeve protector is made of a flat blank of a material, which is turned inward and stitched along its edges. A band 9 of elastic material is sewn within an inward fold of material at the wrist end and is secured by stitches 11. Ends of the elastic band 9 are stitched into the stitching which forms the seam 13. An opening 15 extends axially along the wrist protector between the elbow end 7 and the seam 13. The opening is formed by a continuation of one side of the flap from the seam 13 which is folded inward and secured by stitches 17 The proximal end 7 of the sleeve protector is folded inward and secured by stitches 19. A flap 21 is formed from an extension of the material which extends over the opening 15. Edges of flap 21 are folded inward and are secured by stitches 23.

The flap is held in closed position by first and second pairs of complementary pile and hook fasteners. The first pair 25 is made up of complementary square patches 27 and 29. Patch 27 with small hooks is fixed inside the corner of the flap nearest the seam 13. Patch 29 is fixed to the surface of the tube 3, slightly spaced from the opening 15 and from the end of seam 13. Fastener pair 31 has an adjustable feature. The fastener pair 31 includes an elongated, rectangular hook-type patch 33 and a square pile-type patch 35, which is fixed to an outer surface of the tube near an intersection of the opening 15 and the proximal end 7. The fastener patch 33 is elongated along the proximal end 7 of the flap 21 so that the flap may be positioned to change the circumference of the proximal end 7, thus aiding in holding the sleeve protector on the arm of the user and providing for different types of forearms and clothing sleeves.

As shown in FIG. 1, the opening 15 extends for about 60% of the axial length of the tube 3, and the seam 13 extends for about 40% of the axial length of the tube 3. The long opening 15 and flap 21 provide for ease of access into the tube 3 of the hand and wrist, forearm and sleeve of the user, without pushing of the sleeve toward the elbow and bunching of the sleeve, which might be uncomfortable to the user and which might result in decreased protection. The elastic 9 within the inward formed pocket formed by the stitching 11 provides for close fitting of the sleeve along a wrist of a user without pinching of the wrist.

The large flap and long extension of the flap provide for ease of insertion of one hand, wrist, forearm and sleeve, while holding the flap with the other hand, followed by fastening the flap with the other hand. Thus, the sleeve protectors may be used without assistance by children. When the flap is closed, the child first closes the middle fasteners and then closes the fasteners nearest the elbow, after pulling the flap over so far as is comfortable.

After the use of the sleeve protectors is finished, a child may simply open a flap using the other hand. The wide length of the flap between the fasteners ensures ample room for gripping the flap near a fastener to open one fastener at a time. Preferably, the fastener closest the elbow is opened and that portion of the flap is laid back while the hand is slid along the flap to pull the other fasteners open.

While the invention is intended for re-use, it may be constructed of single use materials or materials designed for few uses. Preferably, the sleeve protector is used until soiled and then is simply washed in an automatic washing machine and is then spun to extract water and then is simply draped over a hanger or tumbled without heat to air-dry. The sleeve protector is immediately ready for re-use. When necessary, the sleeve protector may be sprayed with a commercial waterproofing spray, such as Scotchguard, to retard soil and prolong use between washings.

While the invention has been described with reference to a specific embodiment, modifications and variations may be made without departing from the scope of the invention, which is defined in the following claims.

I claim:

1. A children's sleeve protector comprising a tube made of a flexible fabric material having a distal wrist end and a proximal elbow end, first means at the wrist end for radially inwardly urging the wrist end against the wrist of a user, a seam extending axially along a tube from the distal end, and axial opening means extending axially along the tube from the proximal end to the seam means, and closure means extending axially along the tube commensurate with the opening means for closing the opening means, complementary fastener means connected to the closure means and to the tube adjacent the opening means for holding the closure means closed and closing the opening means.

2. The sleeve protector of claim 1 wherein the seam extends less than halfway axially along the tube and wherein the opening means and closure means extend more than halfway axially along the tube.

3. The sleeve protector of claim 1 wherein the seam extends about 40% of the axial length and the opening means and closure means extend about 60% of the axial length for providing ease of access and introduction of a sleeve to be protected within the opening means and within the sleeve protector.

4. The sleeve protector of claim 1 wherein the opening means comprises an axial extension of one side of the seam and wherein the closure means comprises a flap attached to the material and extending circumferentially in a direction beyond an extension of the other side of the seam.

5. The sleeve protector of claim 4 wherein the fastening means comprise first complementary pile and hook type fastener patches fixed respectively on an inside corner of a portion of the flap which is closest the seam and on the material at a position spaced slightly from an intersection of the opening means and the seam and second complementary fasteners attached to an inside of the flap near the proximal end and attached to the material near a proximal end of the opening.

6. The sleeve protector of claim 5 wherein the second complementary fasteners comprise a pile patch attached to an outside surface of the tube adjacent the proximal end and a complementary elongated hook-type fastener strip, elongated along a proximal edge of an inner surface of the flap for engaging the pile fastener patch of the second fastener means in one of variable positions to control circumferential dimension of the proximal end of the sleeve protector tube.

7. The sleeve protector of claim 1 wherein the wrist tightening means comprises an elastic insert in the sleeve protector within the distal end.

8. The sleeve protector of claim 1 wherein the closure means comprises a flap formed of the material and extending over an axial portion of the material adjacent the opening means and fastened thereto by the fastening means for providing ease of access of a hand, wrist and forearm and a clothing sleeve into the sleeve protector before the flap is closed over the opening means.

9. A children's sleeve protector comprising an elongated tube formed of flexible, moistureproof fabric material having a wrist end and an elbow end, elastic means at the wrist end for closely surrounding a child's wrist, an axial opening extending more than halfway along the tube from the elbow end for allowing ease of passage through the tube of a child's hand and wrist and for allowing ease of entry into the tube the sleeve of a child's garment without bunching, and a flap made of an extended portion of the fabric material and extending over the opening to close the opening after a hand, wrist, arm and sleeve have been inserted, a first complementary pair of hook and pile type fastener patches respectively connected to an inner corner of the flap near an end of the opening remote from the elbow end and on an outer surface of the tube near the opening remote from the elbow end, and a second pair of hook and pile type fastener patches on an inside of the flap near the elbow end and on an outside of the tube near an inner section of the elbow end and opening.

10. The sleeve protector of claim 9 wherein the second fastener patches comprise a square pile type fastener patch connected to an outside of the tube near an intersection of the opening and elbow end and an elongated, rectangular, complementary fastener patch mounted on an inside of the flap and extending along an elbow edge of the flap.

* * * * *